US009349534B2

(12) United States Patent
Kurobe

(10) Patent No.: US 9,349,534 B2
(45) Date of Patent: May 24, 2016

(54) MULTILAYER COIL AND A MANUFACTURING METHOD THEREOF

(71) Applicant: MURATA MANUFACTURING CO., LTD., Kyoto (JP)

(72) Inventor: Junji Kurobe, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/171,274

(22) Filed: Feb. 3, 2014

(65) Prior Publication Data

US 2014/0247102 A1 Sep. 4, 2014

(30) Foreign Application Priority Data

Mar. 1, 2013 (JP) ..... 2013-040467

(51) Int. Cl.
*H01F 5/00* (2006.01)
*H01F 27/28* (2006.01)
*H01F 41/04* (2006.01)

(52) U.S. Cl.
CPC ..... *H01F 41/041* (2013.01); *H01F 5/003* (2013.01); *H01F 41/046* (2013.01)

(58) Field of Classification Search
CPC ..... H01F 41/041
USPC ..... 336/200, 223, 232
See application file for complete search history.

(56) References Cited

U.S. PATENT DOCUMENTS 6,080,468 A * 6/2000 Yamaguchi ..... 428/212
6,264,777 B1 7/2001 Yamaguchi
2008/0012679 A1* 1/2008 Okabe et al. ..... 336/200
2009/0051476 A1 2/2009 Tada et al.
2010/0033286 A1 2/2010 Katayama et al.
2011/0001599 A1* 1/2011 Takenaka et al. ..... 336/200

FOREIGN PATENT DOCUMENTS

CN 1141724 C 3/2004
CN 101090026 A 12/2007
CN 101944415 A 1/2011

(Continued)

OTHER PUBLICATIONS

An Office Action; "Notification of Reasons for Rejection," issued by the Japanese Patent Office on Feb. 3, 2015, which corresponds to Japanese Patent Application No. 2013-040467 and is related to U.S. Appl. No. 14/171,274; with English language translation.

An Office Action; "Notice of Allowance," issued by the Korean Intellectual Property Office on Dec. 16, 2014, which corresponds to Korean Patent Application No. 10-2014-0011450 and is related to U.S. Appl. No. 14/171,274; with English language translation.

(Continued)

*Primary Examiner* — Elvin G Enad
*Assistant Examiner* — Ronald Hinson
(74) *Attorney, Agent, or Firm* — Studebaker & Brackett PC

(57) ABSTRACT

A multilayer coil having a laminate body having a plurality of insulating layers including a specified insulating layer. A linear coil conductor is substantially looped on the specified insulating layer. An insertion is located on the specified insulating layer, in a position between a first part and a second part of the coil conductor. The first part and the second part are closest parts to each other in the coil conductor. Along a boundary surface between the first part of the coil conductor and the insertion, the first part is located at an upper side of the coil conductor with respect to a stacking direction.

4 Claims, 12 Drawing Sheets

(56) References Cited

FOREIGN PATENT DOCUMENTS

| | | | |
|---|---|---|---|
| JP | H08-78236 | A | 3/1996 |
| JP | 2001-093734 | A | 4/2001 |
| JP | 2001-176725 | A | 6/2001 |
| JP | 2005-294486 | A | 10/2005 |
| JP | 2007-200923 | A | 8/2007 |
| JP | 2010-067758 | A | 3/2010 |
| JP | 2012-243787 | A | 12/2012 |
| KR | 2012-0033644 | A | 4/2012 |
| WO | 2008/004633 | A1 | 1/2008 |

OTHER PUBLICATIONS

An Office Action; "Decision of Final Rejection," issued by the Japanese Patent Office on Apr. 14, 2015, which corresponds to Japanese Patent Application No. 2013-040467 and is related to U.S. Appl. No. 14/171,274; with English language translation.

An Office Action; "Decision to Grant a Patent," issued by the Japanese Patent Office on Aug. 11, 2015, which corresponds to Japanese Patent Application No. 2013-040467 and is related to U.S. Appl. No. 14/171,274; with English language translation.

* cited by examiner

MULTILAYER COIL AND A MANUFACTURING METHOD THEREOF

CROSS REFERENCE

This application claims benefit of priority to Japanese Patent Application No. 2013-040467 filed on Mar. 1, 2013, the entire content of which is incorporated herein by reference.

TECHNICAL FIELD

The present disclosure relates to a multilayer coil and a manufacturing method thereof.

BACKGROUND

As a conventional laminated coil, for example, a multilayer electronic component 500 disclosed by Japanese Patent Laid-Open Publication No. 2001-176725 is known. FIG. 28 is a perspective view of the multilayer electronic component 500 disclosed by Japanese Patent Laid-Open Publication No. 2001-176725. FIG. 29 is a plan view of a ceramic green sheet 501*h* and a conductor 502*g* for a coil of the multilayer electronic component 500 disclosed by Japanese Patent Laid-Open Publication No. 2001-176725. In the following paragraphs, a direction in which ceramic green sheets are stacked is referred to as a z-axis direction. A surface at a positive z-axis side is referred to as an upper surface, and a surface at a negative z-axis side is referred to as a lower surface. A lengthwise direction and a widthwise direction of the ceramic green sheets are referred to as an x-axis direction and a y-axis direction, respectively. The x-axis direction, the y-axis direction and the z-axis direction are perpendicular to each other.

The multilayer electronic component 500 comprises ceramic green sheets 501*a* to 501*j*, conductors 502*a* to 502*h* for a coil (which will be hereinafter referred to as coil conductors 502*a* to 502*h*), via-hole conductors 503*a* to 503*g*, and terminal electrodes (not shown). The ceramic green sheets 501*a* to 501*j* are rectangular insulating layers, when viewed from the z-axis direction. The coil conductors 502*a* to 502*g* are linear conductors, each forming a rectangular loop with a missing part. The coil conductor 502*h* is a conductive layer located on the upper surface of the ceramic green sheet 501*i*.

In the multilayer electronic component 500, the ceramic green sheets 501*a* to 501*i* and the coil conductors 502*a* to 502*h* are stacked alternately by disposing the coil conductor 502*h* on the upper surface of the ceramic green sheet 501*i*, disposing the ceramic green sheet 501*h* on the upper surface of the ceramic green sheet 501*i* and the like. However, the ceramic green sheet 501*i* is placed on the upper surface of the ceramic green sheet 501*j*. The coil conductors 502*a* and 502*h* are connected by via-hole conductors 503*a* to 503*g*. The coil conductors 502*a* and 502*h* are connected also to the terminal electrodes located on side surfaces of the multilayer electronic component 500.

In the multilayer electronic component 500, in order to prevent trouble from taking place due to a short-circuit caused by blurring and/or misplacement occurring at the time of printing of the coil conductor 502*g*, as shown by FIG. 29, the distance d500 between pad portions 504 and 505, which are the ends of the coil conductor 502*g*, is set to be large. The pad portion 505 is located separate from the pad portion 504, and specifically, located at a position farther in a negative x-axis direction and farther in a positive y-axis direction from the pad portion 504. With the increase in distance between the pad portions 504 and 505, however, the length of the coil conductor 502*g* is shortened. With regard to the coil conductors 502*a* to 502*f* also, since the distances between the respective pad portions are large, the lengths of the coil conductors 502*a* to 502*f* are short. In the multilayer electronic component 500, therefore, the coil formed of the coil conductors 502*a* to 502*g* has a small number of turns, and it is difficult to obtain desired characteristics as a coil.

SUMMARY

The present disclosure provides a multilayer coil that can prevent a short circuit caused by blurring and/or misplacement occurring at the time of printing of conductors for a coil without reducing the number of turns of the coil.

A multilayer coil according to an embodiment comprises: a laminate body formed by stacking a plurality of insulating layers including a specified insulating layer; a linear coil conductor substantially looped on the specified insulating layer; and an insertion located on the specified insulating layer, in a position between a first part and a second part of the coil conductor, the first part and the second part being closest parts to each other in the coil conductor. In the multilayer coil, along a boundary surface between the first part of the coil conductor and the insertion, the first part is located at an upper side of the coil conductor with respect to a stacking direction.

A method for manufacturing a multilayer coil according to an embodiment is a method for manufacturing a multilayer coil comprising: a laminate body formed by stacking a plurality of insulating layers including a specified insulating layer; a linear coil conductor substantially looped on the specified insulating layer; and an insertion located on the specified insulating layer, in a position between a first part and a second part of the coil conductor, the first part and the second part being closest parts to each other in the coil conductor. The method comprises: a step of forming the specified insulating layer; a step of forming the insertion on the specified insulating layer; and a step of forming the coil conductor on the specified insulating layer after the step of forming the insertion.

DETAILED DESCRIPTION

A multilayer coil according to an embodiment and a manufacture method thereof will be hereinafter described.

Figure 1:
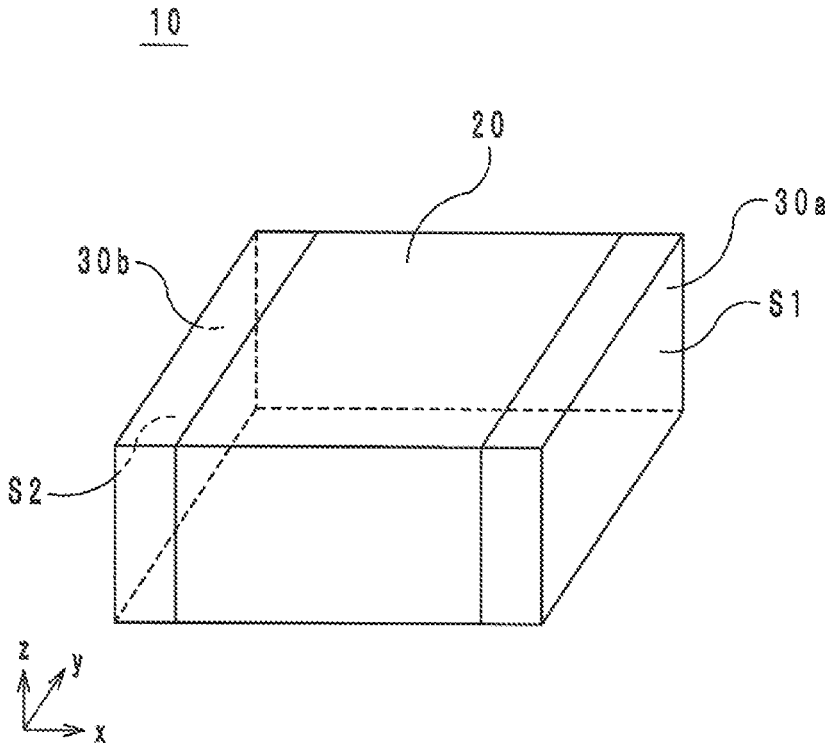
FIG. 1 is a perspective view of a multilayer coil according to an embodiment.
Figure 2:
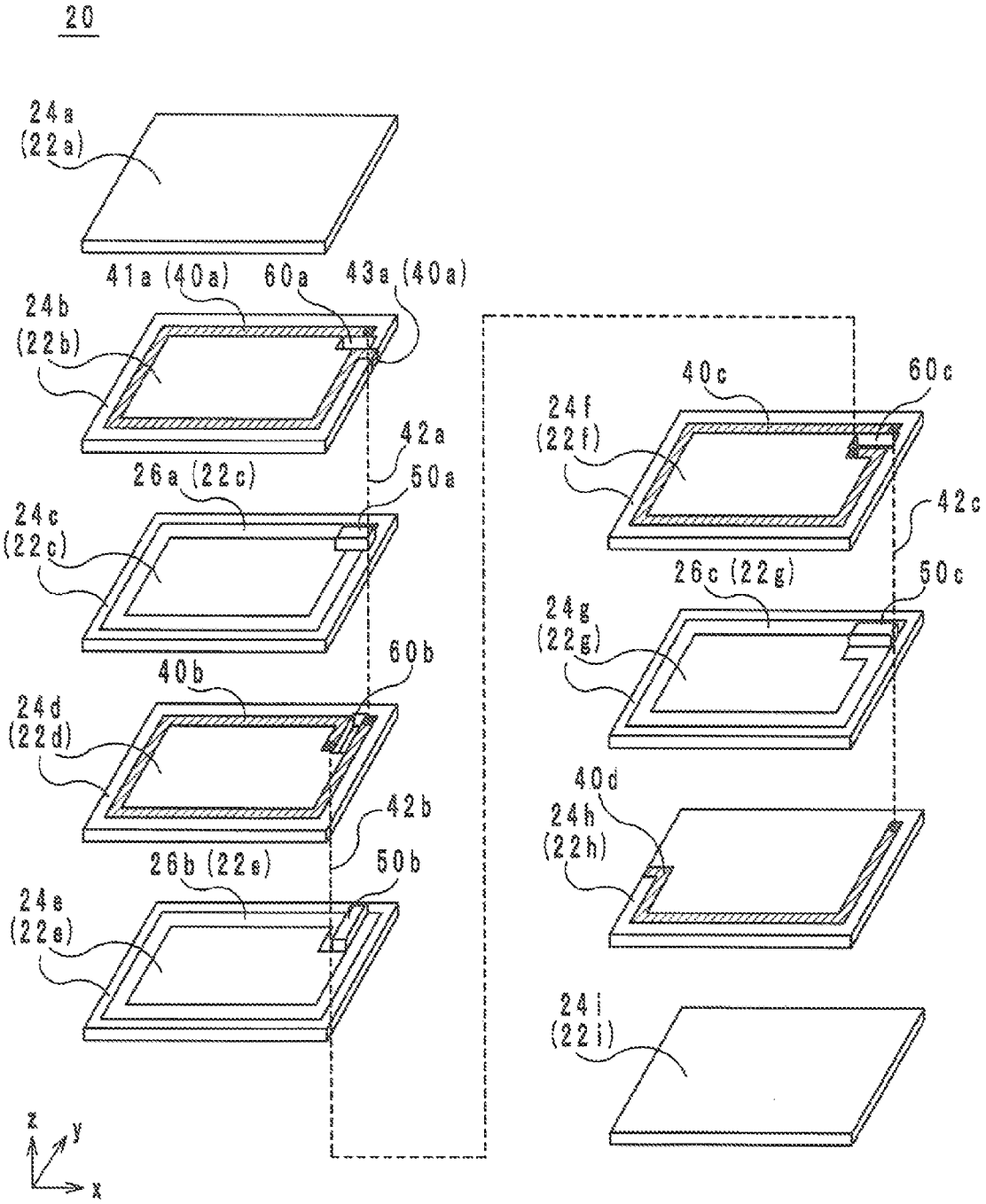
FIG. 2 is an exploded view of a laminate body of the multilayer coil according to the embodiment.
Figure 3:
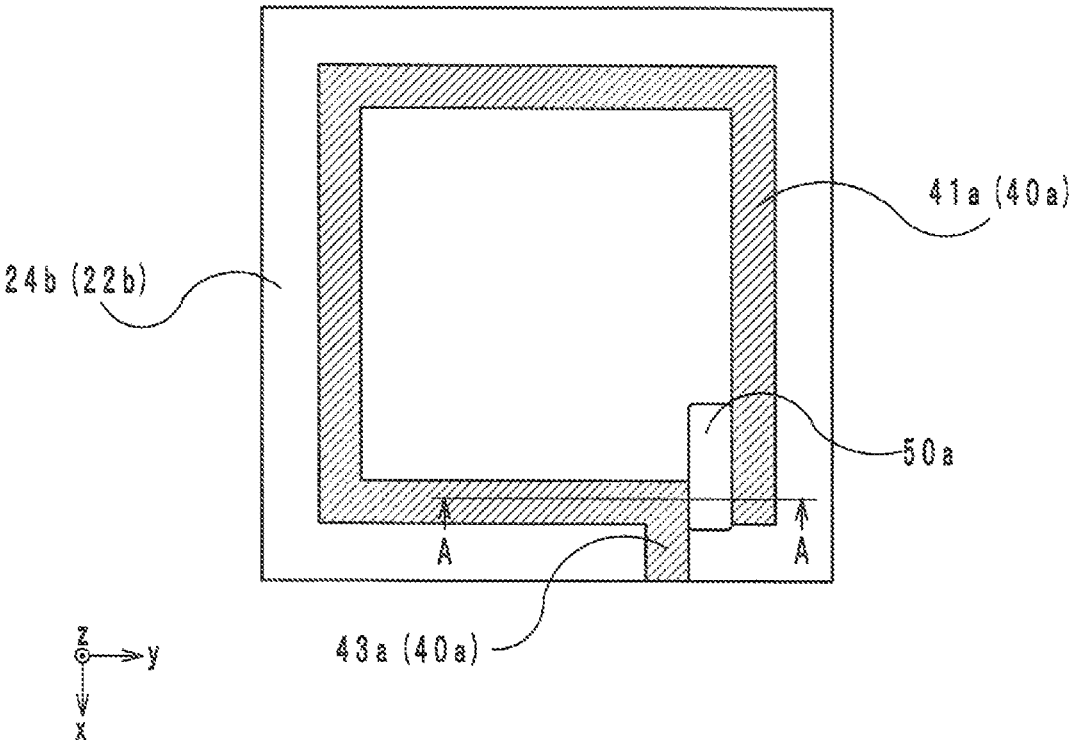
FIG. 3 is a plan view of an insulating layer, a coil conductor and an insertion of the multilayer coil according to the embodiment, when viewed from a layer-stacking direction.
Figure 4:
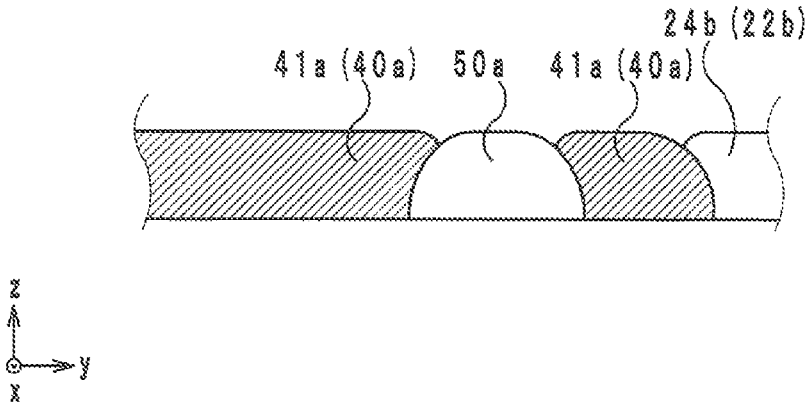
FIG. 4 is a sectional view take along the line A-A shown in FIG. 3.
Figure 5:
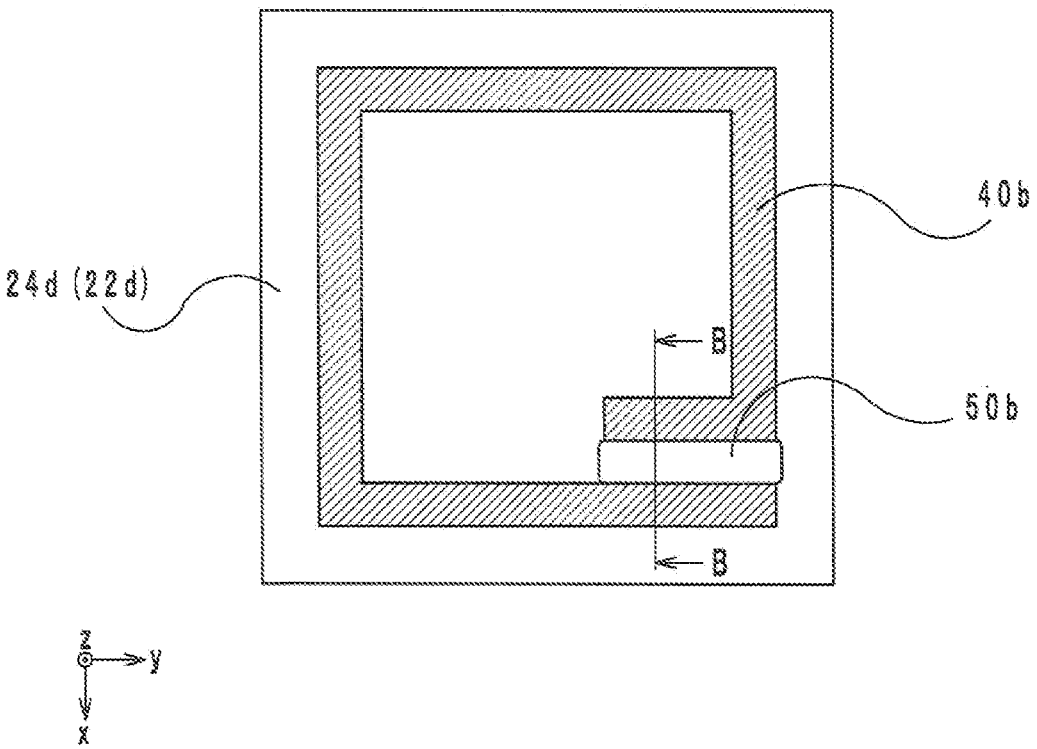
FIG. 5 is a plan view of an insulating layer, a coil conductor and an insertion of the multilayer coil according to the embodiment, when viewed from the layer-stacking direction.
Figure 6:
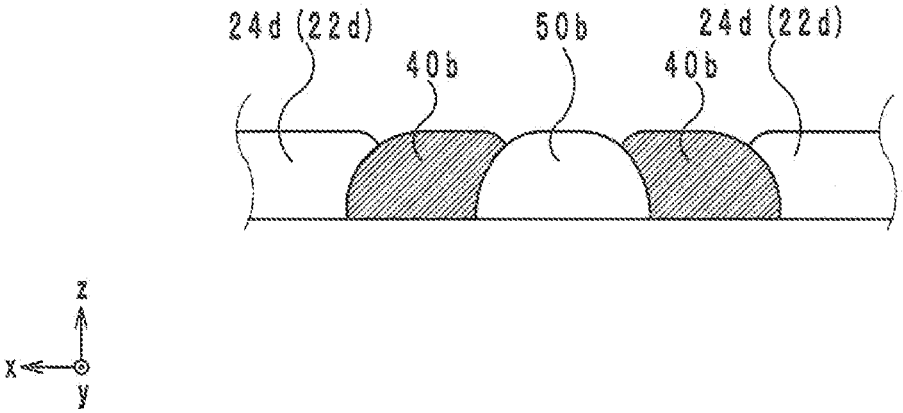
FIG. 6 is a sectional view take along the line B-B shown in FIG. 5.
Figure 7:
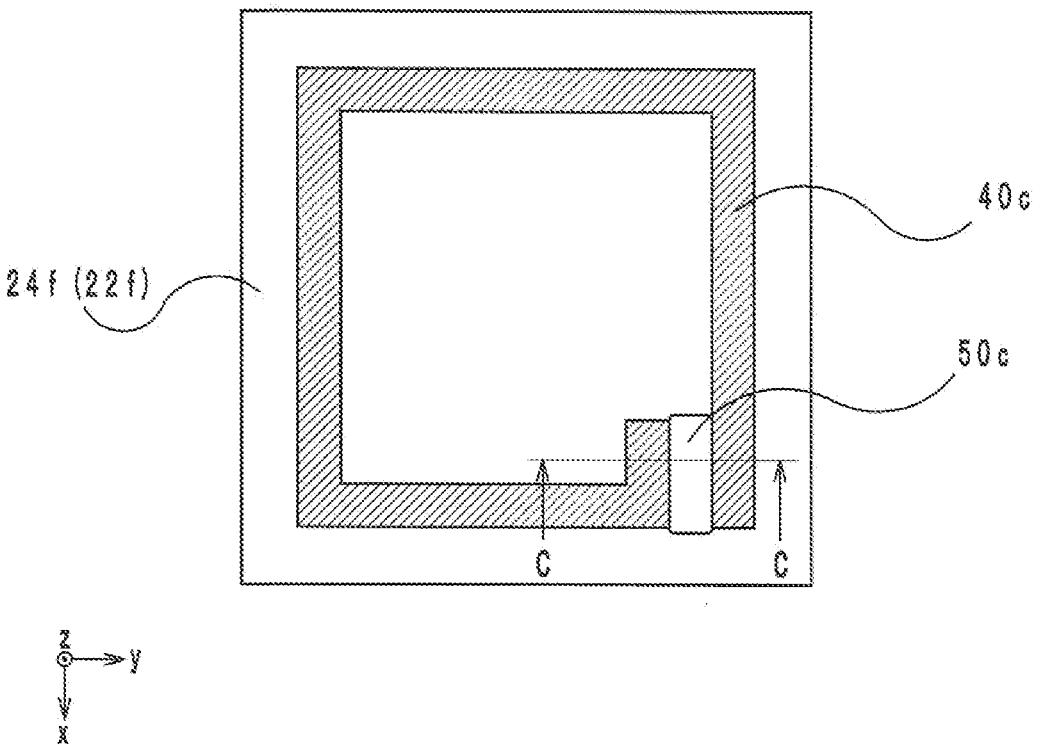
FIG. 7 is a plan view of an insulating layer, a coil conductor and an insertion of the multilayer coil according to the embodiment, when viewed from the layer-stacking direction.
Figure 8:
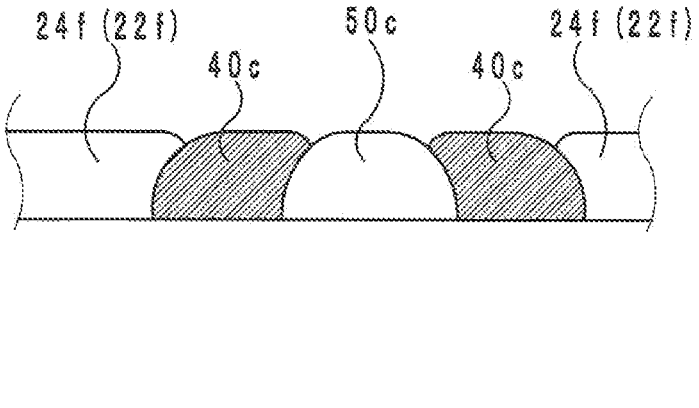
FIG. 8 is a sectional view take along the line C-C shown in FIG. 3.

The structure of a multilayer coil 10 according to an embodiment is described with reference to the drawings. FIG. 1 is a perspective view of the multilayer coil 10. FIG. 2 is an exploded view of the multilayer coil 10. FIG. 3 is a plan view of an insulating layer 22*b*, a coil conductor 40*a* and an insertion 50*a*. FIG. 5 is a plan view of an insulating layer 22*d*, a coil conductor 40*b* and an insertion 50*b*. FIG. 7 is a plan view of an insulating layer 22*f*, a coil conductor 40*c* and an insertion 50*c*. FIG. 4 is a sectional view taken along the line A-A shown in FIG. 3. FIG. 6 is a sectional view taken along the line B-B shown in FIG. 5. FIG. 8 is a sectional view taken along the line C-C shown in FIG. 7. A direction in which the layers of the multilayer coil 10 are stacked is defined as a z-axis direction. Directions in which the sides of the multilayer coil 10 in a plane viewed from the z-axis direction extend are defined as an x-axis direction and a y-axis direction. The x-axis direction and the y-axis direction are perpendicular to each other.

General Structure of the Multilayer Coil

The multilayer coil 10 comprises a laminate body 20, external electrodes 30*a* and 30*b*, coil conductors 40*a* to 40*c*, via-hole conductors 42*a* to 42*c*, and insertions 50*a* to 50*c*. The multilayer coil 10 is, as shown by FIG. 1, a rectangular parallelepiped.

Structure of the Laminate Body

As shown by FIG. 2, the laminate body 20 is formed by stacking insulating layers 22*a* to 22*i* in this order from a positive z-axis side. Each of the insulating layers 22*a* to 22*i* is rectangular when viewed from the z-axis direction. Accordingly, the laminate body 20, which is formed by stacking the insulating layers 22*a* to 22*i*, is a rectangular parallelepiped as shown by FIG. 1. A surface of each of the insulating layers 22*a* to 22*i* at the positive z-axis side is referred to as an upper surface, and a surface of each of the insulating layers 22*a* to 22*i* at the negative z-axis side is referred to as a lower surface.

The insulating layer 22*a* is located at the positive z-axis end of the laminated body 20. The insulating layer 22*a* is a magnetic layer 24*a*. The magnetic layer 24*a* and the magnetic layers 24*b* to 24*i* which will be described later are made of a magnetic material, such as ferrite or the like.

The insulating layer 22*b* is, as shown in FIG. 2, located on the lower surface of the insulating layer 22*a*. The insulating layer 22*b* is a magnetic layer 24*b*. The insulating layer 22*b* has a rectangular through-hole 60*a* pierced therein in the z-axis direction, near a corner made by a positive x-axis side and a positive y-axis side of the insulating layer 22*b*, which are parts of the outer edge of the insulating layer 22*b*. A coil conductor 40*a*, which will be described later, is embedded in the insulating layer 22*b*.

The insulating layer 22*c* (a specified insulating layer) is, as shown in FIG. 2, located on the lower surface of the insulating layer 22*b*. The insulating layer 22*c* comprises a magnetic part 24*c* and a non-magnetic part 26*a*. The non-magnetic part 26*a* is a strip-shaped portion arranged along the outer edge of the insulating layer 22*c* so as to substantially form a rectangular loop, when viewed from the z-axis direction. The magnetic part 24*c* is located outside and inside the rectangular loop made by the non-magnetic part 26*a*, when viewed from the z-axis direction. The non-magnetic part 26*a* and the non-magnetic part 26*b* to 26*c* which will be described later are made of a non-magnetic material, for example, mainly composed of borosilicate glass and ceramic filler, or the like.

The insulating layer 22*d* is, as shown in FIG. 2, located on the lower surface of the insulating layer 22*c*. The insulating layer 22*d* is a non-magnetic layer 24*d*. The insulating layer 22*d* has a rectangular through-hole 60*b* pierced therein in the z-axis direction, near a corner made by a positive x-axis side and a positive y-axis side of the insulating layer 22*d*, which are parts of the outer edge of the insulating layer 22*d*. A coil conductor 40*b*, which will be described later, is embedded in the insulating layer 22*d*.

The insulating layer 22*e* (a specified insulating layer) is, as shown in FIG. 2, located on the lower surface of the insulating layer 22*d*. The insulating layer 22*e* comprises a magnetic part 24*e* and a non-magnetic part 26*b*. The non-magnetic part 26*b* is a strip-shaped portion arranged along the outer edge of the insulating layer 22*e* so as to substantially form a rectangular loop, when viewed from the z-axis direction. The magnetic part 24*e* is located outside and inside the rectangular loop made by the non-magnetic part 26*b*, when viewed from the z-axis direction.

The insulating layer 22*f* is, as shown in FIG. 2, located on the lower surface of the insulating layer 22*e*. The insulating layer 22*f* is a non-magnetic layer 24*f*. The insulating layer 22*f* has a rectangular through-hole 60*c* pierced therein in the z-axis direction, near a corner made by a positive x-axis side and a positive y-axis side of the insulating layer 22*f*, which are parts of the outer edge of the insulating layer 22*f*. A coil conductor 40*c*, which will be described later, is embedded in the insulating layer 22*f*.

The insulating layer 22*g* (a specified insulating layer) is, as shown in FIG. 2, located on the lower surface of the insulating layer 22*f*. The insulating layer 22*g* comprises a magnetic part 24*g* and a non-magnetic part 26*c*. The non-magnetic part 26*c* is a strip-shaped portion arranged along the outer edge of the insulating layer 22*g* so as to substantially form a rectangular loop, when viewed from the z-axis direction. The magnetic part 24*g* is located outside and inside the rectangular loop made by the non-magnetic part 26*c*, when viewed from the z-axis direction.

The insulating layer 22*h* is, as shown in FIG. 2, located on the lower surface of the insulating layer 22*g*. The insulating layer 22*h* is a magnetic layer 24*h*. A coil conductor 40*d*, which will be described later, is embedded in the insulating layer 22*h*.

The insulating layer 22*i* is, as shown in FIG. 2, located on the lower surface of the insulating layer 22*h*. The insulating layer 22*i* is located at the negative z-axis end of the laminate body 20. The insulating layer 22*i* is a magnetic layer 24*i*.

Structure of the External Electrodes

As shown in FIG. 1, the external electrode 30*a* is disposed to cover a side surface S1 at a positive x-axis side of the laminate body 20. The external electrode 30*b* is disposed to cover a side surface S2 at a negative x-axis side of the laminate body 20. The external electrodes 30*a* and 30*b* are made of a conductive material, such as Ag, Pd, Cu, Ni or the like.

Structure of the Coil Conductors

The coil conductor 40*a* is, as shown in FIG. 2, embedded in the insulating layer 22*b*, and has the same thickness as the insulating layer 22*b*. Accordingly, the coil conductor 40*a* is exposed on the lower surface of the insulating layer 22*b* and is located on the upper surface of the insulating layer 22*c* (specified insulating layer). The coil conductor 40*a* comprises a coil portion 41*a* and a lead portion 43*a*.

The coil portion 41*a* is a strip-shaped portion arranged along the outer edge of the insulating layer 22*b* so as to substantially form a rectangular loop, when viewed from the z-axis direction. That is, the coil portion 41*a* is substantially looped on the upper surface of the insulating layer 22*c*. Thus, the coil portion 41*a* has a length substantially corresponding to one turn of a helical coil. However, the coil portion 41*a* is split by the through-hole 60*a*. Accordingly, the coil portion 41*a* has both ends facing each other across the through-hole 60*a*, and the ends are the closest parts to each other in the coil portion 41*a*.

The lead portion 43*a* connects one end (first end) of the coil portion 41*a* to the external electrode 30*a* located on the side surface S1 of the laminate body 20. The other end (second end) of the coil portion 41*a*, that is, the other end of the coil conductor 40*a* is connected to the via-hole conductor 42*a* pierced in the insulating layer 22 in the z-axis direction. Thus, the coil conductor 40*a* connects the external electrode 30*a* to the via-hole conductor 42*a* while circling clockwise, when viewed from the positive z-axis side. The coil conductor 40*a*, the coil conductors 40*b* to 40*d* which will be described later, the via-hole conductor 42*a*, and the via-hole conductors 42*b* to 42*c* which will be described later are made of a conductive material, such as Ag, Pd, u, Ni or the like.

The coil conductor 40*b* is, as shown in FIG. 2, embedded in the insulating layer 22*d*, and has the same thickness as the insulating layer 22*d*. Accordingly, the coil conductor 40*b* is exposed on the lower surface of the insulating layer 22*d* and is located on the upper surface of the insulating layer 22*e* (specified insulating layer). The coil conductor 40*b* is a strip-shaped conductor arranged along the outer edge of the insulating layer 22*d* so as to substantially form a rectangular loop, when viewed from the z-axis direction. That is, the coil conductor 40*b* is substantially looped on the upper surface of the insulating layer 22*e*. Thus, the coil conductor 40*b* has a length substantially corresponding to one turn of a helical coil. However, the coil conductor 40*b* is split by the through-hole 60*b*. Accordingly, the coil conductor 40*b* has both ends facing each other across the through-hole 60*b*, and the ends are the closest parts to each other in the coil conductor 40*b*. One end (first end) of the coil conductor 40*b* is connected to the via-hole conductor 42*a*. Thereby, the coil conductor 40*b* is electrically connected to the coil conductor 40*a*. The coil conductors 40*a* and 40*b* are opposed to each other via the non-magnetic part 26*a*. The other end (second end) of the coil conductor 40*b* is connected to the via-hole conductor 42*b* pierced in the insulating layer 22*e* in the z-axis direction. Thus, the coil conductor 40*b* connects the via-hole conductor 42*a* to the via-hole conductor 42*b* while circling clockwise, when viewed from the positive z-axis side.

The coil conductor 40*c* is, as shown in FIG. 2, embedded in the insulating layer 22*f*, and has the same thickness as the insulating layer 22*f*. Accordingly, the coil conductor 40*c* is exposed on the lower surface of the insulating layer 22*f* and is located on the upper surface of the insulating layer 22*g* (specified insulating layer). The coil conductor 40*c* is a strip-shaped conductor arranged along the outer edge of the insulating layer 22*f* so as to substantially form a rectangular loop, when viewed from the z-axis direction. That is, the coil conductor 40*c* is substantially looped on the upper surface of the insulating layer 22*g*. Thus, the coil conductor 40*c* has a length substantially corresponding to one turn of a helical coil. However, the coil conductor 40*c* is split by the through-hole 60*c*. Accordingly, the coil conductor 40*c* has both ends facing each other across the through-hole 60*c*, and the ends are the closest parts to each other in the coil conductor 40*c*. One end (first end) of the coil conductor 40*c* is connected to the via-hole conductor 42*b*. Thereby, the coil conductor 40*c* is electrically connected to the coil conductor 40*b*. The coil conductors 40*b* and 40*c* are opposed to each other via the non-magnetic part 26*b*. The other end (second end) of the coil conductor 40*c* is connected to the via-hole conductor 42*c* pierced in the insulating layer 22*g* in the z-axis direction. Thus, the coil conductor 40*c* connects the via-hole conductor 42*b* to the via-hole conductor 42*c* while circling clockwise, when viewed from the positive z-axis side.

The coil conductor 40*d* is, as shown in FIG. 2, embedded in the insulating layer 22*h*, and has the same thickness as the insulating layer 22*h*. Accordingly, the coil conductor 40*d* is exposed on the lower surface of the insulating layer 22*h* and is located on the upper surface of the insulating layer 22*i*. The coil conductor 40*d* is a strip-shaped conductor arranged along the positive and negative x-axis sides and the negative y-axis side of the insulating layer 22*h*, which are parts of the outer edge of the insulating layer 22*h*. The part of the coil conductor 40*d* along the negative x-axis side is lead out from substantially the center in the y-axis direction to the side surface S2. Thereby, one end of the coil conductor 40*d* is connected to the external electrode 30*b*. The other end of the coil conductor 40*d* is connected to the via-hole conductor 40*c*. Thus, the coil conductor 40*d* is electrically connected to the coil conductor 40*c*. The coil conductors 40*c* and 40*d* are opposed to each other via the non-magnetic part 26*c*.

Structure of the Insertions

The insertion 50*a* is, as shown in FIG. 2, disposed on the upper surface of the insulating layer 22*c*. The insertion 50*a* is located in the same position as the through-hole 60*a*, when viewed from the z-axis direction. Accordingly, when the insulating layers 22*b* and 22*c* are stacked together, as shown by FIGS. 3 and 4, the insertion 50*a* is located between the both ends (a first part and a second part) of the coil portion 41*a*. The insertion 50*a*, and the insertions 50*b* and 50*c* which will be described later are made of a non-magnetic material, for example, mainly composed of borosilicate glass and ceramic filler, or the like. The insertions 50*a*, 50*b* and 50*c* are preferably non-magnetic, but these insertions 50*a*, 50*b* and 50*c* may be magnetic.

The insertion 50*b* is, as shown in FIG. 2, disposed on the upper surface of the insulating layer 22*e*. The insertion 50*b* is located in the same position as the through-hole 60*b*, when viewed from the z-axis direction. Accordingly, when the insulating layers 22*d* and 22*e* are stacked together, as shown by FIGS. 5 and 6, the insertion 50*b* is located between the both ends (a first part and a second part) of the coil conductor 40*b*.

The insertion 50*c* is, as shown in FIG. 2, disposed on the upper surface of the insulating layer 22*g*. The insertion 50*c* is located in the same position as the through-hole 60*c*, when viewed from the z-axis direction. Accordingly, when the insulating layers 22*f* and 22*g* are stacked together, as shown by FIGS. 7 and 8, the insertion 50*c* is located between the both ends (a first part and a second part) of the coil conductor 40*c*.

Manufacturing Method of the Multilayer Coil

Figure 13:
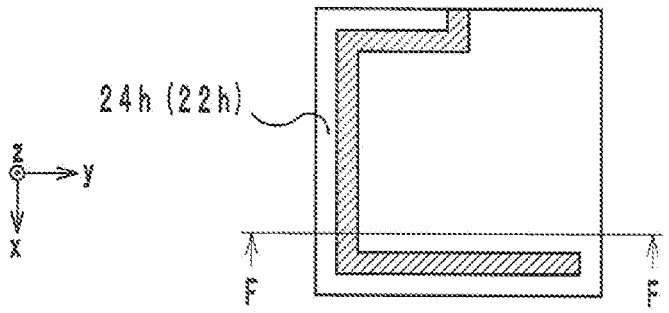
FIG. 13 is a plan view of the multilayer coil according to the embodiment during a manufacturing process thereof, when viewed from the layer-stacking direction.
Figure 14:
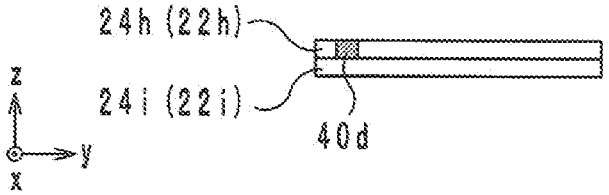
FIG. 14 is a sectional view taken along the line F-F shown in FIG. 13.
Figure 17:
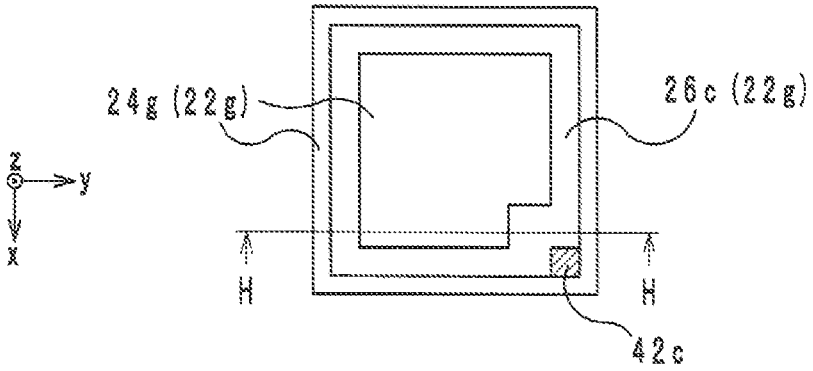
FIG. 17 is a plan view of the multilayer coil according to the embodiment during the manufacturing process thereof, when viewed from the layer-stacking direction.
Figure 18:
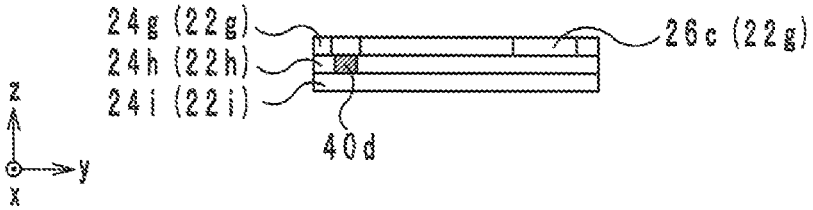
FIG. 18 is a sectional view taken along the line H-H shown in FIG. 17.

A manufacturing method of the multilayer coil 10 is described with reference to the drawings. Although FIGS. 9 to 24 show steps for producing one multilayer coil 10, actually, a mother laminate body that is an aggregation of multilayer coils 10 is produced at one time. FIGS. 9, 11, 13, 15, 17, 19, 21 and 23 are plan views of the multilayer coil 10 viewed from the z-axis direction, during the manufacturing process. FIG. 10 is a sectional view taken along the line D-D shown in FIG. 9. FIG. 12 is a sectional view taken along the line E-E shown in FIG. 11. FIG. 14 is a sectional view taken along the line F-F shown in FIG. 13. FIG. 16 is a sectional view taken along the line G-G shown in FIG. 15. FIG. 18 is a sectional view taken along the line H-H shown in FIG. 17. FIG. 20 is a sectional view taken along the line I-I shown in FIG. 19. FIG. 22 is a sectional view taken along the line J-J shown in FIG. 21. FIG. 24 is a sectional view taken along the line K-K shown in FIG. 23.

Figure 9:
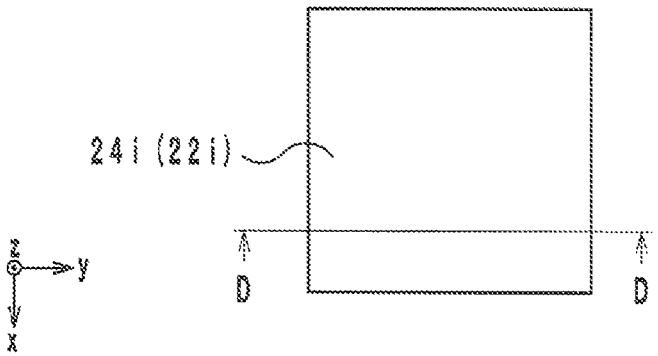
FIG. 9 is a plan view of the multilayer coil according to the embodiment during a manufacturing process thereof, when viewed from the layer-stacking direction.
Figure 10:
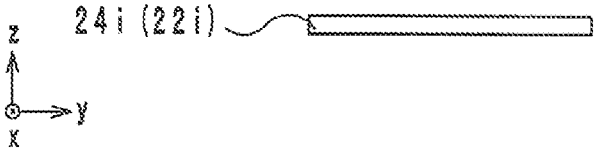
FIG. 10 is a sectional view take along the line D-D shown in FIG. 9.

First, as shown by FIGS. 9 and 10, magnetic paste prepared by mixing ferrite powder, which is a magnetic material, with, for example, a binder is applied onto a substrate, for example, an aluminum substrate (not shown) by printing. The magnetic paste is dried, whereby the insulating layer 22*i* is formed.

Figure 11:
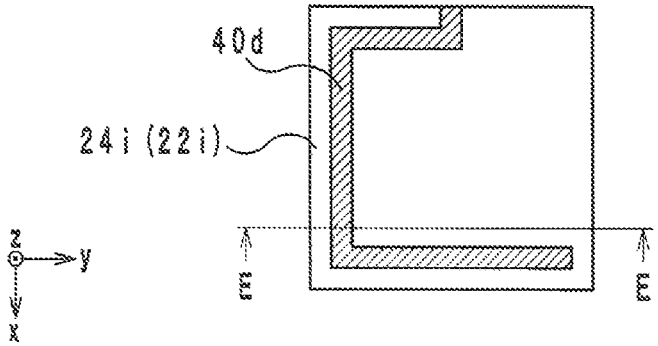
FIG. 11 is a plan view of the multilayer coil according to the embodiment during a manufacturing process thereof, when viewed from the layer-stacking direction.
Figure 12:
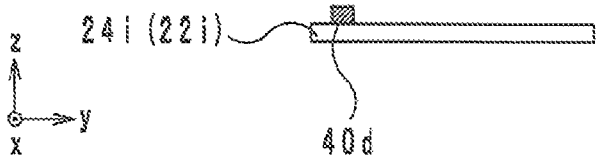
FIG. 12 is a sectional view taken along the line E-E shown in FIG. 11.

Next, as shown by FIGS. 11 and 12, conductive paste mainly consisting of Ag, Pd, Cu, Ni or the like is applied onto the insulating layer 22*i* by printing, and the conductive paste is dried, whereby the coil conductor 40*d* is formed. Further, as shown by FIGS. 13 and 14, the magnetic paste is applied by printing onto the insulating layer 22*i* entirely except for the part on which the coil conductor 40*d* was formed. The magnetic paste is dried, whereby the magnetic layer 24*h* (insulating layer 22*h*) is formed.

Figure 15:
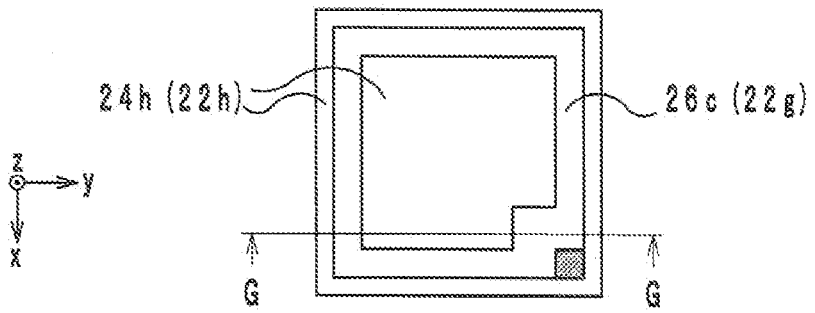
FIG. 15 is a plan view of the multilayer coil according to the embodiment during the manufacturing process thereof, when viewed from the layer-stacking direction.
Figure 16:
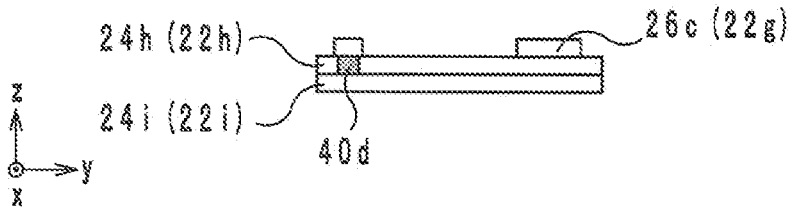
FIG. 16 is a sectional view taken along the line G-G shown in FIG. 15.

Next, as shown by FIGS. 15 and 16, non-magnetic paste mainly composed of borosilicate glass and ceramic filler is applied by printing onto the insulating layer 22*h* and the coil conductor 40*d* so as to cover the coil conductor 40*d*. The non-magnetic paste is dried, whereby the non-magnetic part 26*c* is formed. Further, as shown by FIGS. 17 and 18, the magnetic paste is applied by printing onto the insulating layer 22*h* entirely except for the part on which the non-magnetic part 26*c* was formed. The magnetic paste is dried, whereby the magnetic part 24*g* is formed. In this way, the insulating layer 22*g* is formed. The insulating layer 22*g* is formed so as to have a via-hole for the via-hole conductor 42*c*. After the formation of the insulating layer 22*g*, the conductive paste is filled in the via-hole by printing, whereby the via-hole conductor 42*c* is formed.

Figure 19:
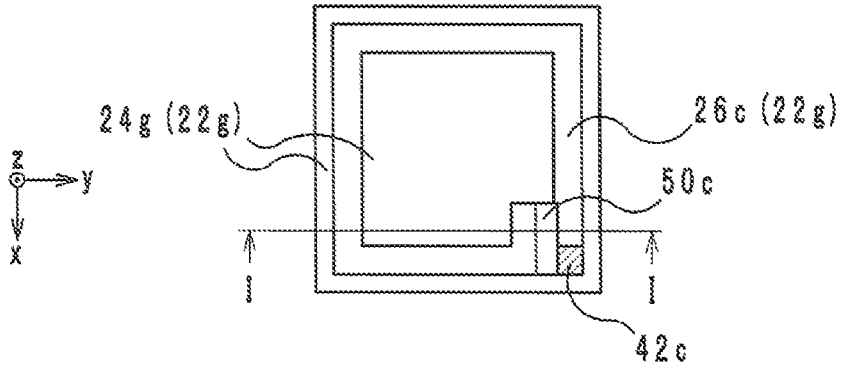
FIG. 19 is a plan view of the multilayer coil according to the embodiment during the manufacturing process thereof, when viewed from the layer-stacking direction.
Figure 20:
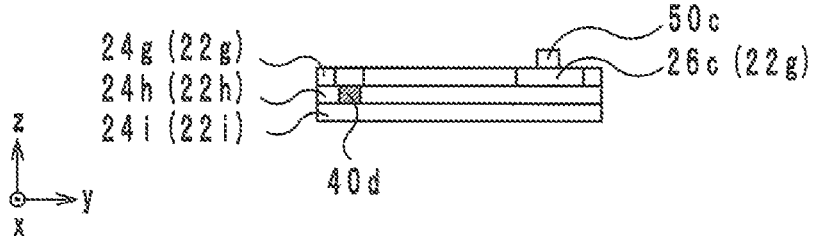
FIG. 20 is a sectional view taken along the line I-I shown in FIG. 19.

Next, as shown by FIGS. 19 and 20, the non-magnetic paste is applied onto the non-magnetic part 26*c* by printing, and the non-magnetic paste is dried, whereby the insertion 50*c* is formed. At this stage, the non-magnetic paste is applied in such a position to be sandwiched between both ends (between the first part and the second part) of the coil conductor 40*c* that will be formed after the formation of the insertion 50*c*, when viewed from the z-axis direction.

Figure 21:
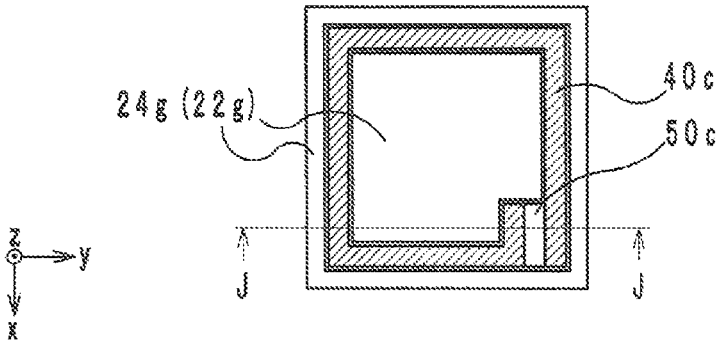
FIG. 21 is a plan view of the multilayer coil according to the embodiment during the manufacturing process thereof, when viewed from the layer-stacking direction.
Figure 22:
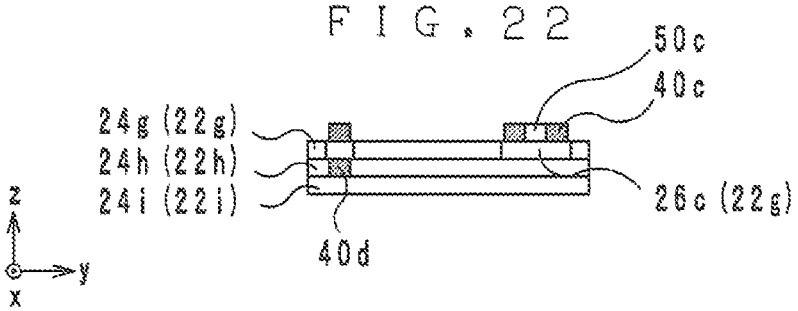
FIG. 22 is a sectional view taken along the line J-J shown in FIG. 21.

Next, as shown by FIGS. 21 and 22, the conductive paste is applied onto the non-magnetic part 26*c* of the insulating layer 22*g* by printing. The conductive paste is dried, whereby the coil conductor 40*c* is formed. In this moment, both ends (the first part and the second part) of the coil conductor 40*c* are separated from each other by the insertion 50*c*. Thus, the conductive paste is applied for formation of the coil conductor 40*c* after the formation of the insertion 50*c*. Therefore, as shown by FIG. 8, the coil conductor 40*c* is formed so as to be located at the positive z-axis side of the insertion 50*c* along the boundary surface between the insertion 50*c* and the coil conductor 40*c*. Specifically, the side surfaces of the insertion 50*c* at the positive and the negative y-axis sides are curved so as to project further in the positive and the negative y-axis directions with increasing distance from the upper surface (the surface at the positive z-axis side) of the insertion 50*c*. Thereafter, the coil conductor 40*c* is formed to cover the side surfaces of the insertion 50*c* from the positive z-axis side.

Figure 23:
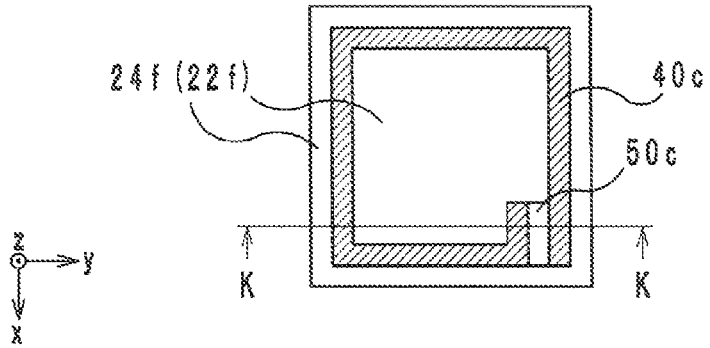
FIG. 23 is a plan view of the multilayer coil according to the embodiment during the manufacturing process thereof, when viewed from the layer-stacking direction.
Figure 24:
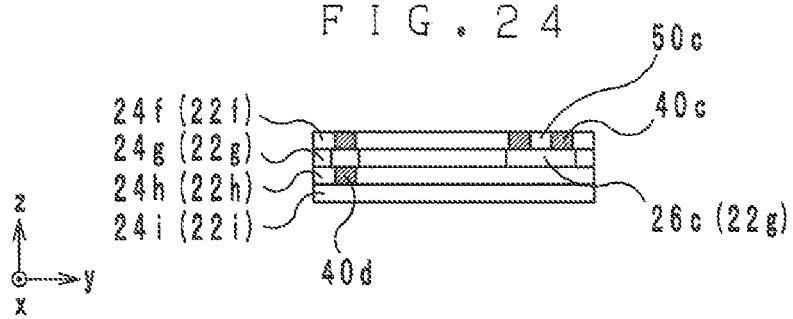
FIG. 24 is a sectional view taken along the line K-K shown in FIG. 23.

Further, as shown by FIGS. 23 and 24, the magnetic paste is applied by printing onto the insulating layer 22*g* entirely except for the parts where the coil conductor 40*c* and the insertion 50*c* were formed. The magnetic paste is dried, whereby the magnetic layer 24*f* (insulating layer 22*f*) is formed.

Subsequently, the steps for forming the insulating layers 22*g* and 22*f*, the coil conductor 40*c*, the via-hole conductor 42*c* and the insertion 50*c* are repeated, whereby the insulating layers 22*b* to 22*e*, the coil conductors 40*a* and 40*b*, the via-hole conductors 42*a* and 42*b*, and the insertions 50*a* and 50*b* are formed. Thereafter, the magnetic paste is applied onto the insulating layer 22*b* by printing, whereby the magnetic layer 24*a* (insulating layer 22*a*) is formed. In this way, an unfired mother laminate body is formed.

Next, the unfired mother laminate body is cut into pieces of a specified size by a dicing saw, whereby a plurality of unfired laminate bodies 20 can be obtained.

The unfired laminate bodies 20 are subjected to debinding and firing. The debinding is carried out, for example, in a hypoxic atmosphere at 400 degrees C. for two hours. The firing is carried out at a temperature within a range from 870 degrees C. to 900 degrees C. for two hours and a half.

Through the steps above, fired laminated bodies 20 can be obtained. Each of the laminated bodies 20 is chamfered by barrel polishing. Thereafter, conductive paste of an Ag-based material is applied to each of the laminated bodies 20, and the applied conductive paste is baked at about 800 degrees C. for one hour. Thereby, silver electrodes for the external electrodes 30*a* and 30*b* are formed.

Finally, the silver electrodes are plated with Ni and/or Sn, whereby the external electrodes 30*a* and 30*b* are formed. Through the steps above, the multilayer coil 10 shown by FIG. 1 is completed.

Advantageous Effects

The multilayer coil 10 and the manufacturing method thereof prevent a short circuit caused by blurring occurring at the time of printing coil conductors without reducing the number of turns of the coil. According to the manufacturing method of the multilayer coil 10, as shown by FIGS. 19 to 22, the insertion 50*c* is formed before the formation of the coil conductor 40*c*. Thereby, the closest parts to each other in the coil conductor 40*c*, that is, both ends of the coil conductor 40*c* are separated by the insertion 50*c* as shown by FIG. 8. Thus, the insertion 50*c* prevents both ends of the coil conductor 40*c* from contacting with each other due to blurring possibly occurring at the time of printing the coil conductor 40*c*. With regard to the coil conductors 40*a* and 40*b*, also, both ends of the respective coil conductors 40*a* and 40*b* are separated by the insertions 50*a* and 50*b*. Thereby, both ends of each of the coil conductors 40*a* and 40*b* are prevented from contacting with each other. Thus, the multilayer coil 10 and the manufacturing method thereof prevent a short circuit caused by blurring occurring at the time of printing coil conductors.

Since the coil conductor 40*c* is formed after the formation of the insertion 50*c*, as shown by FIG. 8, the coil conductor 40*c* is formed so as to be located at the positive z-axis side of the insertion 50*c* along the boundary surface between the insertion 50*c* and the coil conductor 40*c*. This prevents a short circuit from being caused by blurring occurring at the time of printing coil conductors.

In the multilayer coil 10, also, a reduction in inductance value due to magnetic saturation can be alleviated for the following reason. Generally, it is likely that magnetic saturation occurs in an area where coil conductors are located close to each other. Magnetic saturation is likely to occur also in an area where a material with a high-permeability material, that is, a magnetic material is disposed in a space between coil conductors. In the multilayer coil 10, a non-magnetic material is used for the insertions 50*a* to 50*c* that are disposed between the closest parts to each other in the coil conductor 40*a*, between the closest parts to each other in the coil conductor 40*b* and between the closest parts to each other in the coil conductor 40*c*, respectively. Thereby, magnetic saturation is prevented from occurring around the closest parts to each other in the coil conductor 40*a*, the closest parts to each other in the coil conductor 40*b* and the closest parts to each other in the coil conductor 40*c*, that is, around the ends of the coil conductor 40*a*, the ends of the coil conductor 40*b* and the ends of the coil conductor 40*c*, and accordingly, a reduction in inductance value can be alleviated.

Modification

Figure 25:
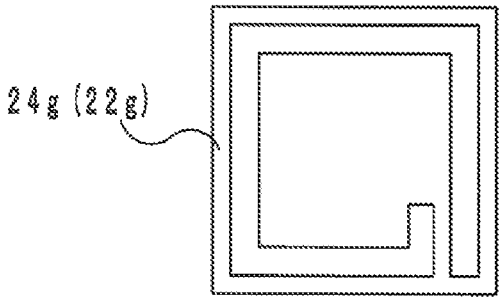
FIG. 25 is a plan view of a print pattern for a magnetic part (insulating layer) of a multilayer coil according to a modification, when viewed from the layer-stacking direction.
Figure 26:
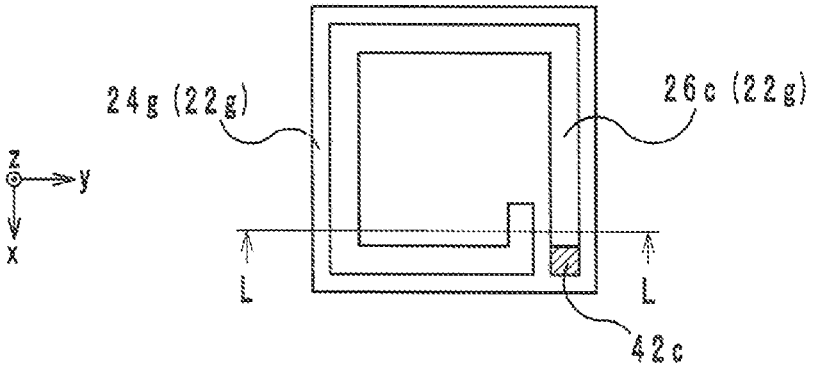
FIG. 26 shows a state where the magnetic part according to the print pattern has been printed.
Figure 27:
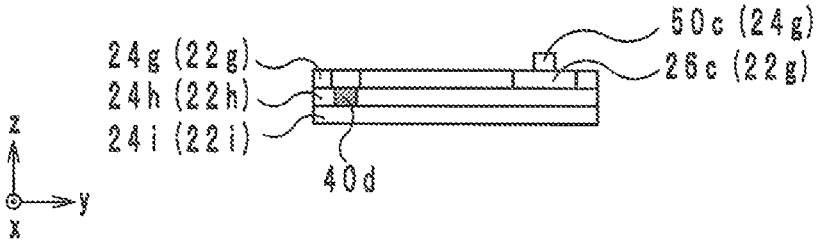
FIG. 27 is a sectional view taken along the line L-L shown in FIG. 26.
Figure 28:
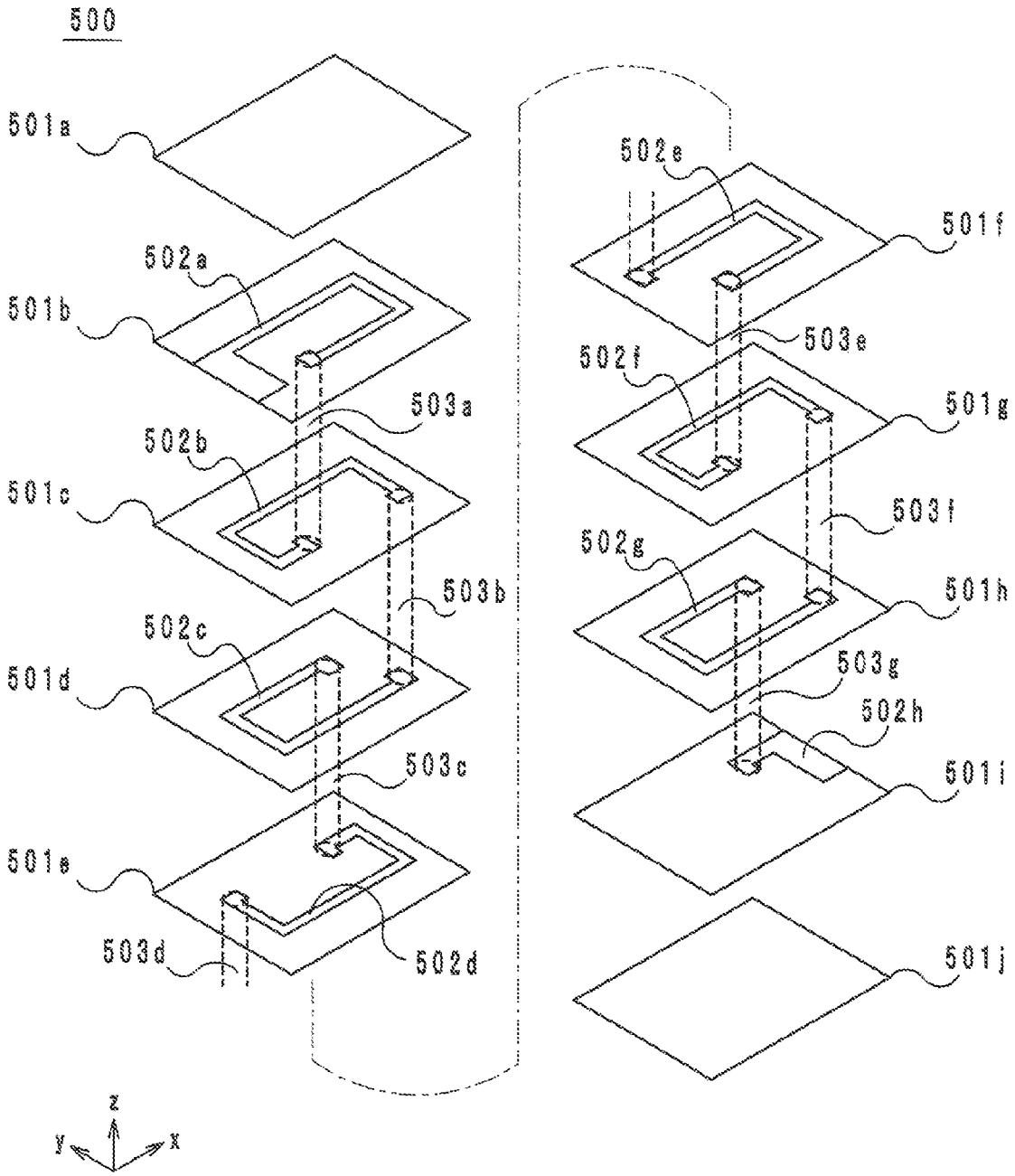
FIG. 28 PRIOR ART
FIG. 28 is a perspective view of a multilayer electronic component disclosed by Japanese Patent Laid-Open Publication No. 2001-176725.
Figure 29:
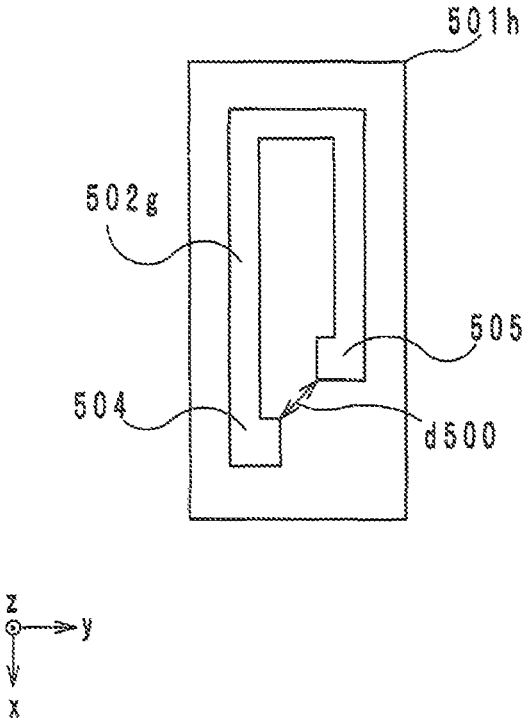
FIG. 29 PRIOR ART
FIG. 29 is a plan view of a ceramic green sheet and a coil conductor of the multilayer electronic component disclosed by Japanese Patent Laid-Open Publication No. 2001-176725.

Next, an alternate multilayer coil according to a modification is described. FIG. 25 is a plan view from the positive z-axis side, showing a print pattern of a magnetic part 24*g* of the alternate multilayer coil. FIG. 26 shows a state where the magnetic part 24*g* has been printed to complete the insulating layer 22*g*. FIG. 27 is a sectional view taken along the line L-L shown in FIG. 26. The same elements and parts of the alternate multilayer coil as the multilayer coil 10 are provided with the same reference marks.

The alternate multilayer coil is different from the multilayer coil 10 in material of the insertions 50*a* to 50*c*. In the alternate multilayer coil, a magnetic material is used for the insertions 50*a* to 50*c*. This simplifies the manufacturing process of the alternate multilayer coil for the following reason.

As shown by FIG. 25, the print pattern of the magnetic part 24*g* for the alternate multilayer coil is partly changed from that for the multilayer coil 10 so that the printed magnetic part 24*g* can be formed to overlap with the non-magnetic part 26*c*. More specifically, as shown by FIG. 26, in a position corresponding to the position of the insertion 50*c* in the multilayer coil 10, the magnetic part 24*g* is printed on the non-magnetic part 26*c* in the alternate multilayer coil. Accordingly, the overlap portion of the magnetic part 24*g* and the non-magnetic part 26*c*, as shown by FIG. 27, protrudes in the positive z-axis direction from the upper surface of the other part of the magnetic part 24*g*. The protrusion made of the magnetic material serves as the insertion 50*c*. Therefore, it is not necessary to form the insertion 50*c* in a separate step after forming the magnetic layer 24*g*. The insulating layers 22*c* and 22*e* may be formed in the same way. Thus, the steps of forming the insertions 50 can be omitted from the manufacturing process of the alternate multilayer coil.

Other Embodiments

Multilayer coils and manufacturing methods thereof according to the present disclosure are not limited to the multilayer coil 10 and the alternate multilayer coil and the manufacturing methods described above. Various changes and modifications may be possible within the scope. In the multilayer coil 10, the insertions 50*a* to 50*c* are located between the ends of the coil conductor 40*a*, between the ends of the coil conductor 40*b*, and between the ends of the coil conductor 40*c*, respectively. However, the insertions 50*a* to 50*c* may be located in any other positions between the close parts to each other in the coil conductor 40*a*, between the close parts to each other in the coil conductor 40*b* and between the close parts to each other in the coil conductor 40*c*, respectively. In each of the coil conductors 40*a* to 40*c*, the closest parts to each other may be other than its both ends. In this case, each of the insertions 50*a* to 50*c* shall be located between the closest parts in each of the conductors other than its both ends.

What is claimed is:

1. A multilayer coil comprising:

a laminate body formed by stacking a plurality of insulating layers including a specified insulating layer;

a linear coil conductor substantially looped on the specified insulating layer; and an insertion located on the specified insulating layer, in a position between a first part and a second part of the coil conductor, the first part and the second part being closest parts to each other in the coil conductor, wherein along a boundary surface between the first part of the coil conductor and the insertion, the first part is located vertically above and in direct contact with an upper side of the insertion with respect to a stacking direction.

2. The multilayer coil according to claim 1, wherein the plurality of insulating layers and the insertion are made of a same material.

3. The multilayer coil according to claim 1, wherein:

parts of the specified insulating layer contacting with one of the coil conductor and the insertion are non-magnetic; and a remaining part of the specified insulating layer is magnetic.

4. The multilayer coil according to claim 1, wherein the insertion is non-magnetic.

* * * * *